US006405735B1

(12) United States Patent
Dockery

(10) Patent No.: US 6,405,735 B1
(45) Date of Patent: Jun. 18, 2002

(54) NAIL POLISH REMOVAL SYSTEM

(76) Inventor: Netrisa T. P. Dockery, 1048 South St., Philadelphia, PA (US) 19147

( * ) Notice: Subject to any disclaimer, the term of this patent is extended or adjusted under 35 U.S.C. 154(b) by 0 days.

(21) Appl. No.: 09/887,224

(22) Filed: Jun. 22, 2001

(51) Int. Cl.[7] ..... A45D 29/18
(52) U.S. Cl. ..... 132/72.5; 206/363
(58) Field of Search ..... 132/74.5, 73; 206/363, 206/361, 362, 229

(56) References Cited

U.S. PATENT DOCUMENTS 2,841,809 A * 7/1958 Oliver ..... 132/74.5
3,342,884 A * 9/1967 Pryor ..... 132/74.5
3,759,375 A * 9/1973 Nappi ..... 206/363
4,022,228 A 5/1977 Ropp et al.
4,173,978 A * 11/1979 Brown ..... 206/363
4,197,212 A 4/1980 Minton et al.
4,255,826 A 3/1981 Boyd
4,282,891 A 8/1981 Duceppe
4,321,936 A 3/1982 Chaconas
4,397,324 A 8/1983 Thomas, Jr.
4,440,181 A 4/1984 Scherer
4,485,037 A 11/1984 Curtis
D277,322 S 1/1985 West
4,699,161 A 10/1987 Smith et al.
4,800,904 A 1/1989 Kinseley et al.
4,801,049 A 1/1989 Thompson
4,804,486 A 2/1989 Day
4,819,672 A 4/1989 Walker et al.
4,824,662 A 4/1989 Hofmann
4,854,761 A 8/1989 Smith et al.
4,884,913 A 12/1989 Smith et al.
D306,083 S 2/1990 Smith et al.
4,932,802 A 6/1990 Cantone
4,938,347 A 7/1990 Tillman
4,952,204 A * 8/1990 Korteweg ..... 206/363
4,964,372 A 10/1990 Zeenni et al.
4,998,839 A 3/1991 Bashir
5,007,441 A 4/1991 Goldstein
5,024,779 A 6/1991 Helioff et al.
5,026,541 A 6/1991 Lanier
5,027,839 A 7/1991 Appell
5,048,547 A 9/1991 Walker
5,063,049 A 11/1991 Billings
5,077,038 A 12/1991 Hofmann
5,112,152 A * 5/1992 McBride ..... 206/229
D329,718 S 9/1992 Sulik
5,173,288 A 12/1992 Everhart et al.
D334,998 S 4/1993 Warner et al.
5,342,536 A 8/1994 Miner et al.
5,346,652 A 9/1994 Dotolo et al.
5,372,742 A 12/1994 Bayless
5,486,305 A 1/1996 Faryniarz et al.
5,543,085 A 8/1996 Miner
5,582,333 A 12/1996 Bennett
5,655,554 A 8/1997 Goldberg
5,769,099 A 6/1998 Davis et al.
5,797,407 A 8/1998 Davis et al.
5,810,021 A 9/1998 Walker (List continued on next page.)

*Primary Examiner*—Todd E. Manahan
(74) *Attorney, Agent, or Firm*—Hovey Williams LLP

(57) ABSTRACT

A nail polish removal system (310) broadly comprises a hollow applicator handle (316) having an applicator end (318) with an absorbent material (320) attached thereto. The handle (316) has an opening (326) at the applicator end (318). The handle (316) contains a breakable capsule (328). Adjacent to the breakable capsule (328) and opposite to the opening (326), the handle (316) has a seal (330). The breakable capsule (328) is filled with up to one ounce of the nail polish removal solution. The breakable capsule (328) is broken releasing the nail polish removal solution. The released nail polish removal solution saturates the absorbent material (320) by flowing through the opening (326). The nail polish removal solution is prevented from escaping the handle (316), other than through the opening (326), by the seal (330). The nail polish removal system (310) is used and discarded.

15 Claims, 2 Drawing Sheets

U.S. PATENT DOCUMENTS 5,855,212 A 1/1999 Walker
5,866,104 A 2/1999 Cataneo et al.
5,961,731 A 10/1999 Cooper-Trotter
5,989,205 A * 11/1999 Pond et al. ..... 206/363
5,992,422 A 11/1999 Ivory
5,996,780 A * 12/1999 Gurrera ..... 206/363
6,028,040 A 2/2000 Jarema
6,035,859 A 3/2000 Antonopoulos-McIvor
6,186,971 B1 * 2/2001 Naughton ..... 206/363

* cited by examiner

NAIL POLISH REMOVAL SYSTEM

BACKGROUND OF THE INVENTION

1. Field of the Invention

The present invention relates to methods and systems for removing cosmetic nail polish from fingernails and toenails. More particularly, the invention relates to a nail polish removal system and method including a conveniently packaged disposable single-use nail polish removal tool comprising an applicator handle and an absorbent material pre-saturated or saturateable with a nail polish removal solution, wherein a plurality of the disposable single-use nail polish removal tools may be provided in a resealable package.

2. Description of the Prior Art

It is often desirable to quickly remove cosmetic nail polish from fingernails and toenails, such as, for example, prior to applying a new cosmetic finish. Currently there exist two general categories of removal means, bottle-based systems and dipping jar-based systems. Bottle-based nail polish removal systems typically include a multiple-use bottle containing a relatively large quantity of a nail polish removal solution sufficient for numerous applications. The bottle opens at one end and must be properly secured with a cap to prevent the solution from spilling. In use, the solution must be controllably poured from the bottle onto a suitable material, such as a cotton ball or a cloth rag. Once the material is saturated with the nail polish removal solution, the user uses his or her fingers to apply the material to a polished nail in order to remove the nail polish therefrom, thereby undesirably simultaneously exposing other nails to the solution. Bottle-based systems are relatively cumbersome and inconvenient to carry in a pocket or purse; are prone to potential leakage which may damage property or expose users to hazardous or flammable fumes or solutions; and are messy to apply.

The problems identified above are greatly compounded for a nail are professional who performs the process of removing nail polish many times each day and is therefore exposed to the hazardous nail polish removal solution on a substantially continuous basis. Although wearing gloves may reduce such exposure, manual dexterity is undesirably inhibited.

An improvement on the bottle-based method involves dipping a conventional swab into the bottle, thereby saturating an absorbent end portion of the swab with the nail polish removal solution. Unfortunately, commonly available swabs are typically not as long as commonly available bottles are deep. Where the swab is unable to reach the bottom of the bottle, the bottle must either be discarded, thereby wasting a portion of the solution, or the solution must be controllably poured from the bottle onto the swab, thereby risking spillage which may damage property or expose users to hazardous or flammable fumes or solutions.

Dipping jar-based systems typically include a multiple-use dipping jar containing a sponge saturated with a relatively large quantity of the nail polish removal solution sufficient for numerous applications. In use, the nail and its associated finger are both inserted into the dipping jar and the polished nail is rubbed against the sponge until all nail polish is removed. Thus, the finger is undesirably soaked in a potentially hazardous and unhealthy combination of the nail polish removal solution and dissolved nail polish.

The dipping jar-based system requires a relatively high level of manual dexterity, which can be a concern for some people, particularly when removing toenail polish. For example, the user is required to either lower the dipping jar to the level of the toe or elevate the toe to the level of the dipping jar. Both methods require that the jar be securely held, in some manner, to prevent spillage, while the toenail is rubbed against the sponge. Lowering the dipping jar to the level of the user's toe necessitates that the user either inconveniently bend over, in order to hold the jar, or place the jar into a holding apparatus. Raising the toe to the dipping jar is equally cumbersome and may not be possible for some users, particularly the elderly or disabled.

Accordingly, there is a need for an improved nail polish removal system that overcomes the limitations of the prior art.

SUMMARY OF THE INVENTION

The nail polish removal system of the present invention overcomes the problems and disadvantages identified above and provides a distinct advance in the art of nail polish removal systems and methods. Specifically, the present invention provides a disposable single-use nail polish removal tool comprising an applicator handle and an absorbent material pre-saturated or saturateable with a nail polish removal solution and packaged in such a manner as to allow use of the tool without spilling or inadvertently contacting the polish removal solution.

In a preferred embodiment, the nail polish removal system comprises a disposable single-use nail polish removal tool and a non-resealable package. The single-use nail polish removal tool includes an applicator handle having an applicator end and an absorbent material attached thereto. The absorbent material is saturated with the nail polish removal solution. At least the absorbent material is sealed in the non-resealable package to contain and retain the polish removal solution. The tool is conveniently stored and transported in quantities of one or more.

In use, a user removes and discards the non-resealable package. The user then rubs the absorbent material, saturated with the nail polish removal solution, against the nail polish to be removed. Once the nail polish has been removed, the user discards the single-use nail polish removal tool. Thus, cumbersome bottles are eliminated; spilled polish removal solution is avoided; and the user avoids undesirable contact with the potentially hazardous polish removal solution.

In another preferred embodiment, the applicator handle is hollow and releasably contains the nail polish removal solution by means of either a breakable capsule or a breakable seal. Thus, the packaging, in this embodiment, is not relied upon to contain or retain the polish removal solution. The hollow applicator handle also includes a substantially nonbreakable seal opposite the applicator end.

In use, a user breaks the breakable capsule or the breakable seal to release the nail polish removal solution from the handle's applicator end. Pieces of the broken capsule or broken seal are prevented from escaping the handle by the absorbent material. Once released, the polish removal solution saturates the absorbent material. The user then removes the nail polish as described above and thereafter discards the nail polish removal system.

These and other important features of the present invention are more fully described in the section titled DETAILED DESCRIPTION OF A PREFERRED EMBODIMENT, below.

BRIEF DESCRIPTION OF THE DRAWINGS

A preferred embodiment of the present invention is described in detail below with reference to the attached drawing figures, wherein.

DETAILED DESCRIPTION OF A PREFERRED EMBODIMENT

Figure 1:
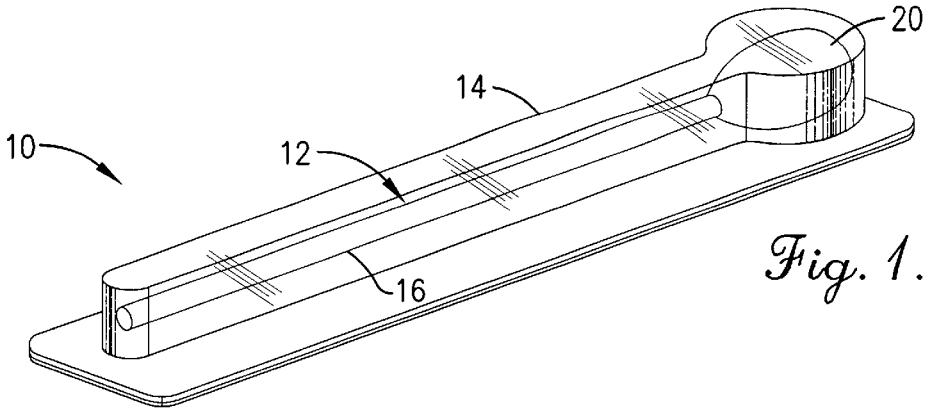
FIG. 1 is an isometric view of a preferred first embodiment of the nail polish removal system packaged in a blister-type package.
Figure 2:
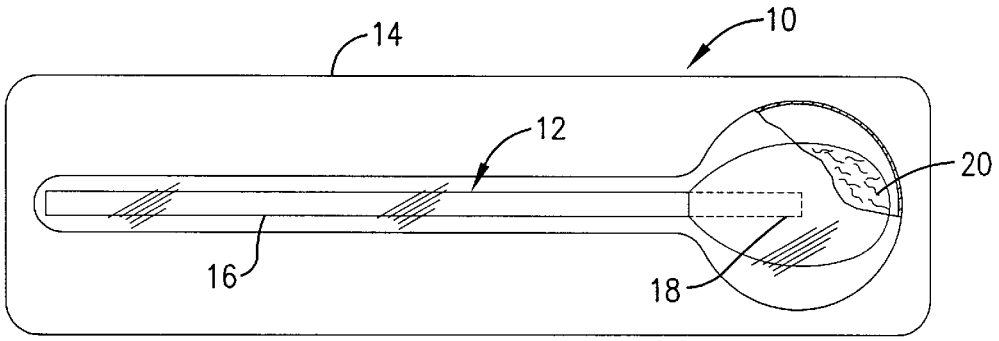
FIG. 2 is a plan view of a preferred first embodiment of the nail polish removal system packaged in a blister-type package, as shown in FIG. 1, with a portion of the blister-type package cut away.

Referring to FIG. 1 and FIG. 2, a nail polish removal system 10 is shown constructed in accordance with a preferred first embodiment of the present invention. The preferred nail polish removal system 10 broadly comprises a single-use nail polish removal tool 12 conveniently packaged in a non-resealable blister package 14. The tool 12 broadly comprises an applicator handle 16 having an applicator end 18 with an absorbent material 20 attached thereto. The applicator handle 16 can be constructed of any substantially rigid material, such as, for example, wood, plastic, metal, or even tightly rolled paper. The applicator handle's length will depend on the intended use. For example, nail polish removal systems 10 designed to be used on fingernails have an optimal length of between 1.0–6.0 inches. Nail polish removal systems 10 designed to be used on toenails have an optimal length of between 3.0–8.0 inches, wherein the longer handle 16 provides a longer reach with less effort. The optimal diameter of the applicator handle 16 is between 1/16–5/16 inch.

The absorbent material 20 is saturated at a production facility with a nail polish removal solution, such as, for example, a commonly available acetone-based nail polish removal solution. The absorbent material 20 is saturated under controlled conditions, thereby virtually eliminating spillage and exposure risks. Furthermore, such saturation can be conducted by automated machines, thereby substantially eliminating human exposure to large quantities of the polish removal solution.

The absorbent material 20 can be constructed of any material having the ability to absorb and retain fluid, such as, for example, cotton, wool, sponge, felt, or paper. The absorbent material 20 is attached to the applicator end 18 by a commonly used manufacturing means of attachment, such as, for example, a glue compound. The glue compound used as the attachment means must be of a composition not affected by prolonged contact with the nail polish removal solution.

The tool 12 is sealed in the non-resealable blister package 14. The commonly used blister package 14 is constructed of a plastic member and a backing member. The plastic member is formed to accommodate the tool 12. The backing member is constructed of any material capable of forming a seal with the plastic member, such as, for example, foil. Once the tool 12 has been placed into the plastic member, the backing member is secured to the plastic member, thereby sealing the tool therewithin. A plurality of the non-resealable blister packages 14 can be detachably attached, for example, by manufacturing a plurality of the non-resealable blister packages 14 as one unit and adding standard perforations, in order to facilitate convenient transportation of the plurality of the nail polish removal systems 10.

In use, the package 14 is opened by bending the package 14 until the applicator handle 16 is forced through the backing member. The user grasps the tool 12 by the applicator handle 16, thereby avoiding any undesirable contact with the nail polish removal solution. The package 14 is pulled free of the tool 12 and discarded. The absorbent material 20, saturated with the polish removal solution, is rubbed against the nail polish to be removed. Once the nail polish has been removed, the user discards the tool 12. Thus, the user avoids spillage and undesirable exposure to the polish removal solution.

Figure 3:
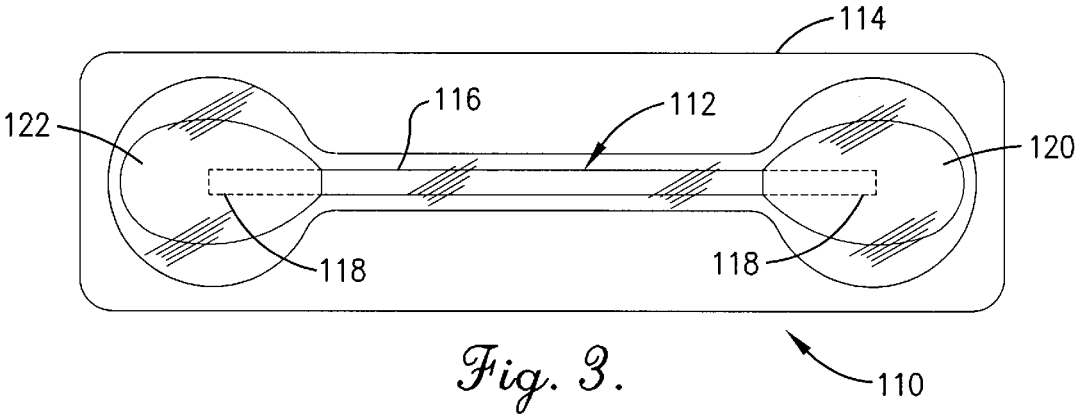
FIG. 3 is a plan view of a preferred second embodiment of the nail polish removal system, wherein the applicator handle has two applicator ends.

Referring to FIG. 3, a nail polish removal system 110 is shown constructed in accordance with a preferred second embodiment of the present invention. The preferred second embodiment 110 is substantially similar to the preferred first embodiment 10, described above, with the exception that the tool 112 broadly comprises an applicator handle 116 having two applicator ends 118 with an absorbent material 120, 122 attached to each applicator end. The absorbent material 120 attached to one applicator end 118 is saturated with the nail polish removal solution. While it is possible to saturate both absorbent materials 120, 122, doing so requires the user to be more careful in order to avoid undesirable contact with the nail polish removal solution.

In use, the nail polish removal system 110 is used as described above, and then the unsaturated absorbent material 122 is rubbed against the nail in order to remove any remaining residue before discarding the tool 112. The unsaturated absorbent material 122 can be constructed of a material different than the absorbent material 120. Such a design feature would allow the unsaturated absorbent material 122 to be more abrasive, thereby aiding removal of any remaining polish residue.

It is understood that a plurality of the tools could be packaged in a resealable package or bag. In operation, the user opens the resealable package, removes one of a plurality of the tools, and then reseals the resealable package. The tool is used and discarded as described above, retaining the resealable package until all of the tools have been used and discarded.

Figure 4:
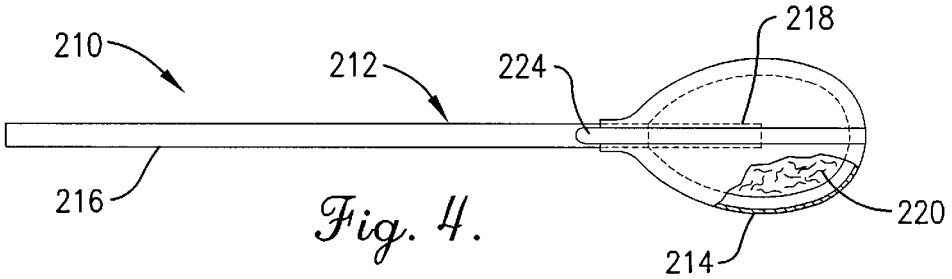
FIG. 4 is a plan view of a preferred third embodiment of the nail polish removal system packaged in a foil-type package, with a portion of the foil-type package cut away.

Referring to FIG. 4, a nail polish removal system 210 is shown constructed in accordance with a preferred third embodiment of the present invention. The preferred third embodiment 210 is substantially similar to the preferred first embodiment 10, described above, with the exception that the package 214 is constructed of a foil-type packaging material. It is understood that the package 214 can be constructed of any suitable material capable of providing a substantially airtight seal. The package 214 can include a quick release tab 224. The tool 212 can be constructed as described in either the preferred first embodiment 10 or the preferred second embodiment 110.

In use, removal of the package 214 is simplified by pulling the quick release tab 224; the package 214 may then be discarded. The tool 212 is used and discarded as described above.

Figure 5:
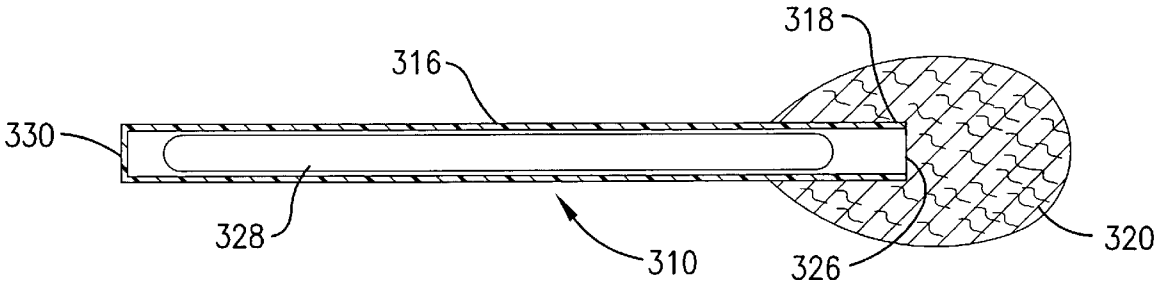
FIG. 5 is a sectional plan view of a preferred fourth embodiment of the nail polish removal system, cut along a longitudinal center line, wherein the applicator handle is hollow and contains a breakable capsule.

Referring to FIG. 5, a nail polish removal system 310 is shown constructed in accordance with a preferred fourth embodiment of the present invention. The nail polish removal system 310 broadly comprises a hollow applicator handle 316 having an applicator end 318 with an absorbent material 320 attached thereto. The hollow applicator handle 316 is preferably constructed of plastic. The hollow applicator handle 316 length is similar to the length of the applicator handle 16 of the preferred first embodiment 10; however, the diameter is optimally between ⅛–⅝ inch. The hollow applicator handle 316 has an opening 326 at the applicator end 318. The hollow applicator handle 316 contains a breakable capsule 328. Adjacent to the breakable capsule 328 and opposite to the opening 326, the hollow applicator handle 316 has a seal 330.

The breakable capsule 328 is filled with up to one ounce of the polish removal solution. The actual quantity of polish removal solution is a matter of design, within the following limitation. A minimum volume is determined by the concentration of the polish removal solution, such that there is sufficient solution to adequately remove polish from an average fingernail. The largest hollow applicator handle 316, with regard to the described optimal dimensions, imposes a one ounce maximum volume.

The breakable capsule 328 is designed to be easily broken by crushing or bending and is preferably constructed of a rigid material, such as, for example, thin glass or plastic. An alternative to a rigid breakable capsule 328 is to construct the breakable capsule 328 of a more flexible material, such as foil. In this alternative, the breakable capsule 328 is filled to its maximum capacity, such that exertion of a small force is sufficient to rupture the capsule 328.

In use, the breakable capsule 328 is broken by squeezing or bending the hollow applicator handle 316, releasing the nail polish removal solution. Pieces of the breakable capsule 328 are prevented from escaping the hollow applicator handle 316 by the absorbent material 320. The user orients the nail polish removal system 310, such that the absorbent material 320 is substantially lower than the hollow applicator handle 316. The released polish removal solution saturates the absorbent material 320 by flowing through the opening 326 in the hollow applicator handle 316. The polish removal solution is prevented from escaping the hollow applicator handle 316, other than through the opening 326, by the seal 330. The polish removal system 310 is used and discarded as described above.

Figure 6:
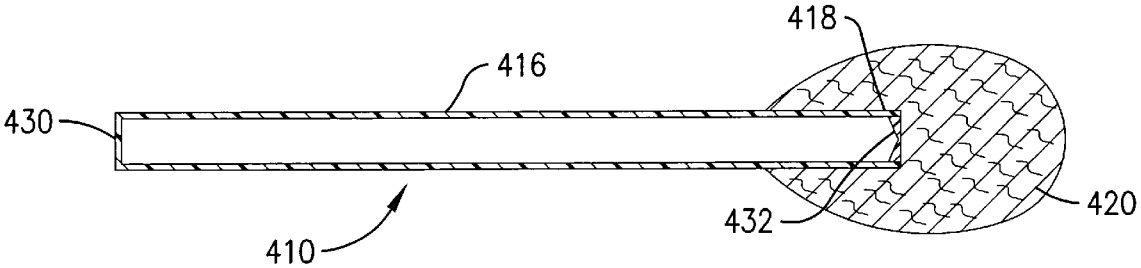
FIG. 6 is a sectional plan view of a preferred fifth embodiment of the nail polish removal system, cut along a longitudinal center line, having a hollow applicator handle containing a nail polish removal solution.

Referring to FIG. 6, a nail polish removal system 410 is shown constructed in accordance with a preferred fifth embodiment of the present invention. The nail polish removal system 410 broadly comprises a hollow applicator handle 416 with dimensions similar to the hollow applicator handle 316 of the preferred fourth embodiment 310, having an applicator end 418 with an absorbent material 420 attached thereto. The hollow applicator handle 416 has a breakable seal 432 constructed of thin rigid plastic at the applicator end 418. Opposite to the breakable seal 432, the hollow applicator handle 416 has a substantially non-breakable seal 430. The hollow applicator handle 416 contains up to one ounce of the nail polish removal solution.

In use, the breakable seal 432 is broken by squeezing the applicator end 418, thereby releasing the polish removal solution. Pieces of the breakable seal 432 are prevented from escaping the hollow applicator handle 416 by the absorbent material 420. The user orients the nail polish removal system 410, such that the absorbent material 420 is substantially lower than the hollow applicator handle 416. The released polish removal solution saturates the absorbent material 420 by flowing through the broken seal 432 in the hollow applicator handle 416. The nail polish removal solution is prevented from escaping the hollow applicator handle 416, other than through the broken seal 432, by the substantially non-breakable seal 430. The nail polish removal system 410 is used and discarded as described above.

Figure 7:
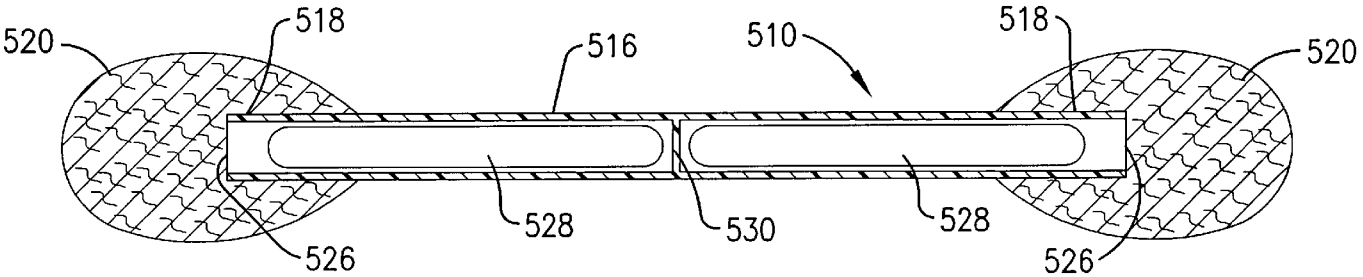
FIG. 7 is a sectional plan view of a preferred sixth embodiment of the nail polish removal system, cut along a longitudinal center line, wherein the applicator handle is hollow and contains two breakable capsules.

Referring to FIG. 7, a nail polish removal system 510 is shown constructed in accordance with a preferred sixth embodiment of the present invention. The nail polish removal system 510 broadly comprises a hollow applicator handle 516 similar to the hollow applicator handle 316 of the preferred fourth embodiment 310, having two applicator ends 518 with an absorbent material 520 attached to each applicator end 518. The hollow applicator handle 516 has an opening 526 at each applicator end 518 with a substantially non-breakable seal 530 roughly in the middle of the hollow applicator handle 516. The hollow applicator handle 516 contains a breakable capsule 528 similar to the breakable capsule 328 of the preferred fourth embodiment 310, on each side of the substantially non-breakable seal 530. It is possible for the breakable capsules 528 to contain different solutions, such as the nail polish removal solution, a nail conditioning solution, or a mild cleaner, for removing dissolved nail polish. The nail polish removal system 510 is used similarly to the nail polish removal system 310 of the preferred fourth embodiment, except that both applicator ends 518 can be used prior to being discarded.

From the preceding description, it can be seen that the nail polish removal system of the present invention, in its various described embodiments, provides a conveniently packaged single-use nail polish removal tool. A number of design advantages are provided, including packaging the nail polish removal tool with the nail polish removal solution in such a manner as to avoid spillage and undesirable exposure to the polish removal solution.

Although the invention has been described with reference to the five preferred embodiments illustrated in the attached drawings, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A nail polish removal system comprising:

a hollow applicator handle having an applicator end;

a capsule constructed, of breakable material located within the hollow applicator handle and containing a volume of nail polish removal solution; and an absorbent material attached to the applicator end of the hollow applicator handle, wherein the nail polish removal solution saturates the absorbent material when the capsule is broken.

2. The nail polish removal system as set forth in claim 1, wherein the applicator handle is between one inch and eight inches in length.

3. The nail polish removal system as set forth in claim 1, wherein the applicator handle is between one eighth of an inch and five eighths of an inch in diameter.

4. The nail polish removal system as set forth in claim 1, wherein the applicator handle releasably contains up to one ounce of the nail polish removal solution.

5. The nail polish removal system as set forth in claim 1, wherein the hollow applicator handle includes a breakable capsule containing the nail polish removal solution, the nail polish removal solution being released from the breakable capsule and the hollow applicator handle when the breakable capsule is broken.

6. The nail polish removal system as set forth in claim 5, wherein the absorbent material is operable to filter pieces of the breakable capsule, after it has been broken, containing the pieces within the applicator handle.

7. The nail polish removal system as set forth in claim 5, wherein the hollow applicator handle includes two breakable capsules, each containing the nail polish removal solution, the nail polish removal solution being released from the breakable capsule and the hollow applicator handle when the breakable capsule is broken.

8. The nail polish removal system as set forth in claim 5, wherein the hollow applicator handle includes two breakable capsules, each containing a different solution selected from the group consisting of: the nail polish removal solution, a nail conditioning solution, or a mild cleaning solution for removing dissolved nail polish, the solution being released from the breakable capsule and the hollow applicator handle when the breakable capsule is broken.

9. The nail polish removal system as set forth in claim 1, wherein the applicator end of the hollow applicator handle is sealed with a breakable seal, the nail polish removal solution being released from the hollow applicator handle when the breakable seal is broken.

10. The nail polish removal system as set forth in claim 9, wherein the absorbent material is operable to filter pieces of the breakable seal, after it has been broken, containing the pieces within the applicator handle.

11. The nail polish removal tool as set forth in claim 1, wherein at least a portion of the hollow applicator handle is constructed of a flexible material so as to facilitate breaking the capsule.

12. The nail polish removal system as set forth in claim 1, wherein the absorbent material is secured to the hollow applicator handle with glue.

13. A nail polish removal system comprising:

a hollow applicator handle having an applicator end;

a seal constructed of breakable material located within the hollow applicator handle and providing containment therewithin of a volume of nail polish removal solution; and an absorbent material attached to the applicator end of the hollow applicator handle, wherein the nail polish removal solution saturates the absorbent material when the seal is broken.

14. The nail polish removal system as set forth in claim 13, wherein the absorbent material is secured to the hollow applicator handle with glue.

15. A nail polish removal system comprising:

a hollow applicator handle having an applicator end, with at least a portion of the hollow applicator handle being constructed of a flexible material;

a space defined by a breakable material located within the hollow applicator handle and providing containment therewithin of a volume of nail polish removal solution; and an absorbent material attached with glue to the applicator end of the hollow applicator handle, wherein the nail polish removal solution saturates the absorbent material when the breakable material is broken.

* * * * *